US005228497A

United States Patent [19]

Romanowski

[11] Patent Number: 5,228,497

[45] Date of Patent: Jul. 20, 1993

[54] ROLL CASTING MACHINE CROWN CONTROL

[75] Inventor: Christopher A. Romanowski, Lake Arrowhead, Calif.

[73] Assignee: Hunter Engineering Company, Inc., Riverside, Calif.

[21] Appl. No.: 670,497

[22] Filed: Jun. 6, 1991

Related U.S. Application Data

[63] Continuation of Ser. No. 379,884, Jul. 14, 1989, abandoned.

[51] Int. Cl.[5] ..... B22D 11/06; B22D 11/124

[52] U.S. Cl. ..... 164/480; 164/428; 164/443; 164/448

[58] Field of Search ..... 164/443, 485, 479, 480, 164/428, 429, 448

[56] References Cited

U.S. PATENT DOCUMENTS

| | | | |
|---|---|---|---|
| 2,693,012 | 11/1954 | Harris | 164/448 |
| 3,757,847 | 9/1973 | Sofinsky et al. . | |
| 4,088,295 | 5/1978 | Medovar et al. . | |
| 4,285,388 | 8/1981 | Sevastakis . | |
| 4,489,772 | 12/1984 | McLane et al. | 164/423 |
| 4,493,361 | 1/1985 | Sevastakis . | |
| 4,671,340 | 6/1987 | Larrecq et al. | 164/443 |
| 4,706,734 | 11/1987 | Sevastakis . | |
| 4,721,154 | 1/1988 | Christ et al. | 164/423 |
| 4,802,528 | 2/1989 | Terrasse | 164/448 |
| 4,825,935 | 5/1989 | Tozawa et al. | 164/443 |

FOREIGN PATENT DOCUMENTS

| | | | |
|---|---|---|---|
| 3326746 | 2/1985 | Fed. Rep. of Germany | 164/443 |
| 61-262452 | 11/1986 | Japan | 164/423 |
| 62-238050 | 10/1987 | Japan | 164/443 |
| 1-113155 | 5/1989 | Japan | 164/443 |

*Primary Examiner*—Richard K. Seidel
*Assistant Examiner*—Rex E. Pelto
*Attorney, Agent, or Firm*—Knobbe, Martens, Olson & Bear

[57] ABSTRACT

The crown of roll cast sheet is regulated by controlling the crown of the work rolls in a roll casting machine producing the sheet. The work roll crowns are controlled by providing differential cooling between the center and the ends of the rolls. The work rolls contain inlet and outlet water plenums which are connected to channels within the perimeter of the rolls. Water flow to the center and ends of the work rolls is controlled by movable sleeves within the plenums. In a first position of the sleeves, water is permitted to flow proportionally through all areas to the work rolls providing an even removal of heat from the rolls. In a second position, a greater portion of water flows through the center portion of the work rolls resulting in increased removal of heat from the center areas, reducing the temperature of these areas and the crowning of the of the work rolls. The sleeves may be moved incrementally between the first and second positions providing control over the size of the work roll crowns and the resulting crown of the sheet produced by the rolls.

23 Claims, 5 Drawing Sheets

ROLL CASTING MACHINE CROWN CONTROL

CROSS-REFERENCE TO RELATED APPLICATIONS

This is a continuation of application Ser. No. 07/379,884, filed Jul. 14, 1989, now abandoned.

FIELD OF THE INVENTION

The present invention relates generally to a machine for the continuous roll casting of metal sheet directly from molten metal, and in particular to the control of the crown of the sheet by controlling the crown of the work rolls in such a machine.

BACKGROUND OF THE INVENTION

In the practice of the present invention the crowns of the work rolls in a continuous roll casting machine are controlled by providing variable cooling internally to the rolls.

It is known to use water to internally cool work rolls as disclosed in U.S. Pat. Nos. 3,757,847 to Sofinsky et al., and 4,671,340 to Larrecq et al. Effective cooling is not only necessary for prolonging the life of work rolls, but is also necessary to withdraw heat from the metal being roll cast.

Controlling the temperature of work rolls is also desirable for maintaining a constant distance between rolls during the roll casting operation. If the temperature of a work roll is permitted to increase, its perimeter will move outward due to its thermal expansion, reducing the thickness of the sheet being roll cast.

As well as controlling the overall temperature of work rolls, it is also desirable to control the temperature in various portions of a roll. The center of a work roll tends to heat up more than its ends, resulting in the formation of a thermally induced crown on the roll. As little as a ten degree differential between the center and the ends of a roll may cause a crown to develop.

A limited amount of crowning is desirable to offset the bending of the work rolls by the sheet being cast. However, excessive crowning will cause sheet to be roll cast thinner in its center portion than at its edges. This is undesirable when the sheet is to be cast flat, for example, when foil will be made from the sheet. It is also undesirable for most other products where sheet is preferably roll cast slightly thicker, rather than thinner in its center, to allow the sheet to be self centering during subsequent rolling operations. Control of the crown of work rolls is therefore desirable to permit control of the shape of the sheet being roll cast.

Current internal work roll cooling systems may provide greater cooling to the center of the roll than to its ends to control excessive crowning. However, the relationship between the amount of cooling water circulating in the center of the roll and its ends is fixed. Due to the variability of cooling requirements caused by the roll casting of different metals at differing thicknesses, excessive work roll crowning may still occur with these internal cooling systems.

Water may be sprayed on the exterior of work rolls in a rolling mill to provide differential cooling as disclosed in U.S. Pat. No. 3,784,153 to Ross et al. External cooling of work rolls, however, is practical only for machines having rolls of a relatively small diameter, such as the type used for finishing work. Larger work rolls, have too great a mass and heat input from the molten metal to be responsive to water sprayed on their perimeters.

External cooling of work rolls in a casting machine, additionally, has notable disadvantages. If a significant amount of cooling water should contact the molten metal being cast, the rapid expansion of the water into steam may cause molten metal to be sprayed out from the casting machine, causing a danger to nearby personnel. External cooling water may also be damaging to equipment. The carriers, guides and feed tips which provide molten metal to roll casting machines are made with asbestos or ceramic materials which are easily damaged by exposure to water.

Thus, there exists a substantial need for an improved system to better control the crown of work rolls in roll casting machines, and the crown of sheet produced by such machines, without the drawbacks of the systems discussed above.

SUMMARY OF THE INVENTION

The present invention comprises a roll casting machine having a frame supporting a pair of water cooled work rolls mounted in the frame for rotation about parallel axes. Molten metal to be cast is introduced into the bite between the work rolls. Means are provided for controlling the cooling capacity of the water in at least a portion of one of the work rolls for providing a controlled temperature differential between the middle of the roll and the ends of the roll.

In an exemplary embodiment of the invention the work rolls comprise a core having an axially extending cooling water plenum, a shell secured on the core, and a plurality of cooling water channels in the perimeter of the core with a plurality of radially extending cooling water passages between the plenum and the channels A sleeve in the plenum has a plurality of openings located to communicate with the radially extending passages. The sleeve is movable between a first position with the openings in relatively greater alignment with at least a portion of the radially extending passages, and a second position with the openings in a relatively lesser alignment with such radially extending passages.

Moving the sleeve from the first position to the second position permits control of the relative amount of cooling water delivered to various portions of the work roll. In one position an even flow of water may be delivered to all portions of the roll. In the other position, relatively more or less water may be directed to a portion of the roll, such as its center, to reduce or increase the amount of crowning of the work roll. The flow of water between the first position and the second position may be incrementally changed to provide a greater control over the work roll crown. Control of the work roll crown permits the desired control of the crown of the sheet being cast.

BRIEF DESCRIPTION OF THE DRAWINGS

The above-mentioned and other features of this invention are more fully set forth in the following description of the presently preferred embodiments, which description is presented with reference to the accompanying drawings, wherein.

DETAILED DESCRIPTION

Figure 1:
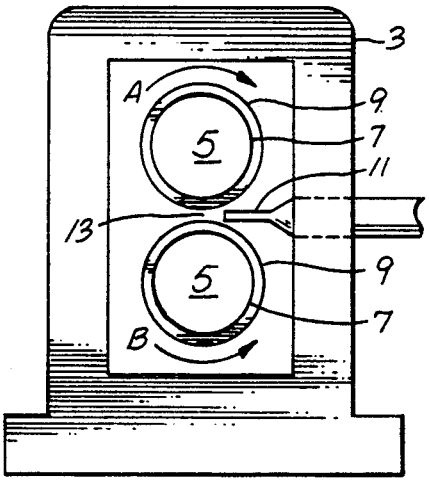
FIG. 1 is a schematic side elevation view of a continuous caster.

The present invention provides a roll casting machine with an improved cooling system which may be used to control the crown of continually cast sheet by differential cooling of the work rolls producing the sheet. The system operates by controlling the flow of internal cooling water in different portions the work rolls. The casting machine has a frame 3 in which two work rolls 5 are mounted for rotation about parallel axes. The work rolls are made from a steel core 7 on which a steel shell 9 has been placed while thermally expanded. The shell is then cooled to create a shrink fit about the core. During operation of the casting machine, the work rolls are rotated as shown by the pointers A and B while molten metal is fed from a feed tip 11 into the bite 13 between the rolls. Heat is absorbed by the rolls, crystallizing the metal which emerges from the rolls in the form of a hot rolled strip.

Figure 2:
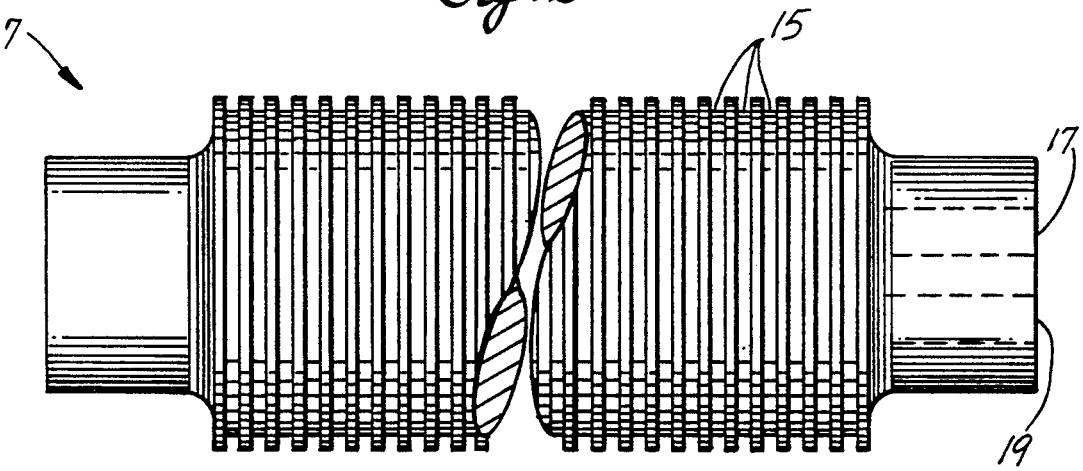
FIG. 2 is a side elevation view of a work roll core incorporating features of the invention.
Figure 3:
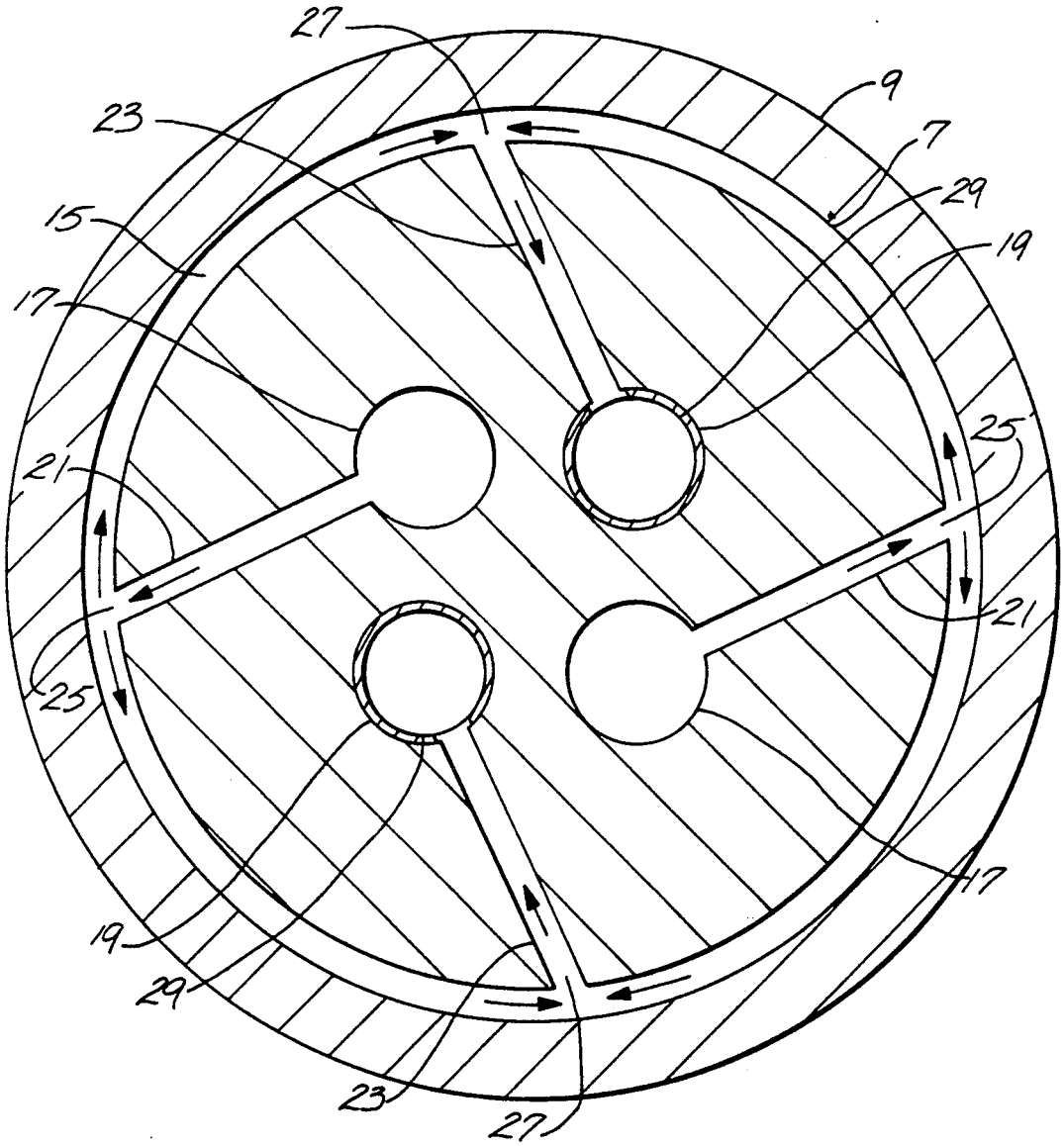
FIG. 3 is a transverse cross-sectional view through a work roll incorporated in a presently preferred embodiment of the invention.

Referring now to FIG. 2, a work roll core 7 is shown without its surrounding shell A plurality of circumferential channels 15 are formed in the perimeter of the core preferably in the form of annular rings, but which may be in other configurations, be interconnected, or be formed as a continuing spiral. One or more cooling water inlet plenums 17, and one or more discharge plenums 19 are bored or cast axially within the core. Four plenums, two inlet 17 and two outlet 19, are presently used, as may best be seen in FIG. 3.

A plurality of radially extending passages 21 and 23 extend from the plenums 17 and 19, respectively, interconnecting the circumferential channels 15 with the plenums. Each channel is connected to a pair of inlet passages 21 at two points 25 180° apart. Each channel is also connected to a pair of outlet passages 23 at two points 27 180° apart and 90° from the inlet passage connection points 25. When differing numbers of plenums and/or passages are used, or other channel configurations are used, the interconnection points between the passages and the channels may be at other locations within the channels.

During roll casting operations, heat is removed from the shell and core by cooling water. Water is admitted to the core through the inlet plenums 17. Water flows through the inlet passages to the annular channels. The water flows 90° in either direction away from each inlet passage-channel connection point to one of the pair of outlet passage-channel connection points 90° away. The water flows through the outlet passages 23 to the outlet plenums 19. The water is then discharged from the core.

A greater cooling capacity for any portion of the core may be created by increasing the size of the inlet and outlet passages within that section of the core. In a presently preferred embodiment of the invention, the size of the inlet and outlet passages are larger in the center portion than in the ends of the core.

Water is circulated through the core by a cooling water pump attached to the plenums (not shown). The outlet side of the pump is preferably attached to the inlet plenums to create a positive pressure within the cooling system. Connection of the outlet of the pump to the inlet of the cooling water system is preferred because the positive water pressure created thereby reduces the formation of steam bubbles within the system, improving its efficiency.

A sleeve is slidably engaged in one or more of the inlet or outlet plenums to control water flow through the cooling system. Preferably, one sleeve 29 is used in each outlet plenum. When a sleeve reduces water flow into an outlet plenum, back pressure is created upstream of the sleeve, additionally contributing to the reduction of formation of steam bubbles.

The sleeves each have openings through their sidewalls which can be aligned with the radial outlet passages various sizes, shapes and configurations of openings may be used to permit controlled amounts of cooling water to flow through the sleeves when the sleeves are moved to different positions within the outlet plenum. The sizes, shapes and configuration of the openings may be altered about the circumference or along the axis of the sleeve for this purpose.

For example, openings may be configured in the sleeves to permit the same or more water to flow through the center portion of the core than in the end portions As a result, independent control of the temperature between the center and the ends of the core is provided In the event of a heat buildup in the center portion of the work roll and excess crowning occurs due to thermal expansion of the roll, more water is temporarily directed to the channels near the center of the core. This increases the cooling of the center portion of the work roll, bringing the roll to a controlled temperature gradient along its length, thereby reducing the crown as required.

If it is desired to enlarge the crown on a roll, the cooling water to the center portion of the core is reduced. This permits the center portion to become warmer relative to the ends of the roll. The resultant thermal expansion of the core increases the diameter of the roll in the center portion, creating the desired enlargement of the crown.

Figure 4:
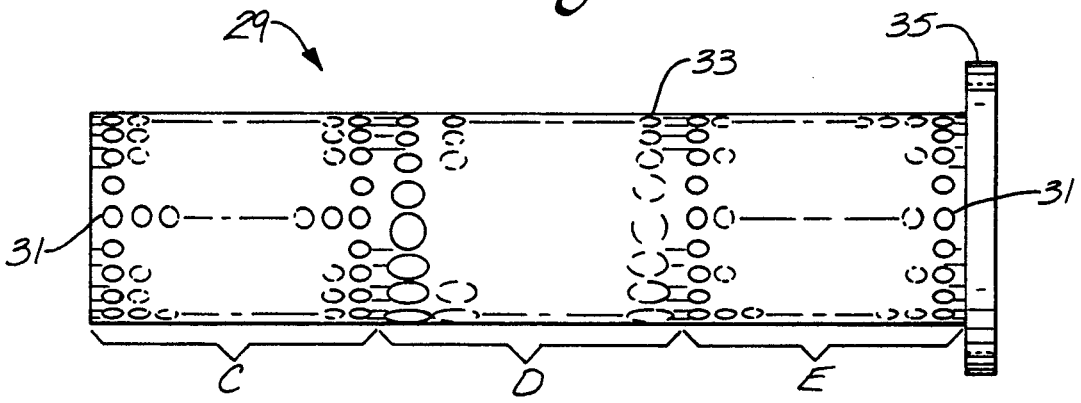
FIG. 4 is a schematic side elevation view of a sleeve incorporated in the work roll embodiment shown in FIG. 3.

In a presently preferred embodiment of the invention, shown in FIG. 4, the openings in the sleeve are circular holes 31, 33. The holes are placed in adjacent rows circumferentially around the sleeve such that they may be aligned with the radial outlet passages. In the end portions of the sleeve, indicated by braces C and E in FIG. 4, the holes 31 are all the same size and are of the same size as the outlet passages with which they align. In the center portion of the sleeve, indicated by brace D, the holes 33 decrease regularly in size around the circumference of the sleeve from a size equal to the radial outlet passages with which they align to a predetermined amount smaller than the passages.

The center portion holes 33 and the radial outlet passages with which they align are sized to permit a significantly larger amount of water to flow through the center portion of the core than the end portions when the largest holes are aligned with the center outlet passages. During sheet rolling operation this flow reduces the relative temperature of the center portion of the core, reducing the crown of the work roll.

The smallest of the center portion holes 33 are sized to provide sufficiently less water to flow through the center portion of the core so as to permit the relative temperature of the center portion of the core to increase the amount required to permit the crown of the work roll to increase when this is desired.

The sleeve is incrementally movable between a maximum and a minimum flow position. In the maximum flow position the end holes and the largest of the center holes are aligned with the outlet passages. In the minimum flow position the end holes and the smallest of the center holes are aligned with the outlet passages. Thus, the total amount of water flowing throughout the cooling system may be varied as required to maintain the desired temperatures in the center and end portions of the work roll.

If a temperature buildup begins in the center of the work roll and excess crowning occurs, the sleeves may be incrementally moved towards their maximum flow positions. At each increment of movement, larger openings are aligned with the center outlet passages, permitting more cooling water to flow through these channels. Further increases of cooling water flow to the center portion of the core are stopped when the flow is sufficient to balance the temperature throughout the work roll and the crow is reduced to the desired level.

Conversely, the sleeves may be incrementally moved towards their minimum flow positions, reducing the water flow through the center portion of the work rolls if more roll crown is needed to obtain the desired sheet profile.

Figure 6:
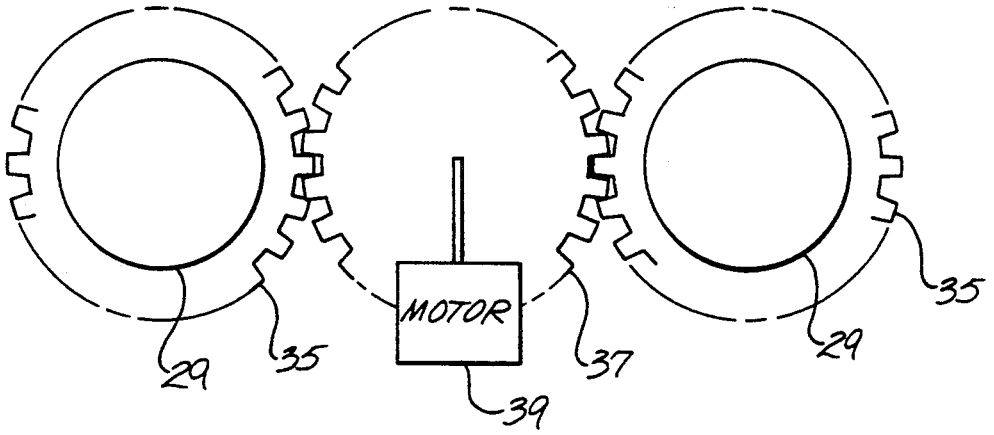
FIG. 6 is a schematic front elevation view of one means for moving the sleeve shown in FIG. 4.

Referring now to FIG. 6, the sleeves may be synchronously moved between their maximum flow positions and their minimum flow positions by electrical, mechanical, hydraulic, manual or other means. For example, each sleeve may have a ring gear 35 fixed to its end extending from the core. Both ring gears 35 are driven by a pinion gear 37. The pinion gear is in turn driven by an electric motor 39. Beginning from any position of the sleeves, actuating the electric motor, which may be a stepper motor, rotates the sleeves a distance sufficient to align the next adjacent set of openings 31 and 33 with the outlet passages 23. This operation may be repeated in combination with varying the total volume of water pumped through the work rolls to achieve and maintain the desired temperature profile along the length of the work roll, and hence the desired work roll crown and the desired sheet profile.

Figure 5:
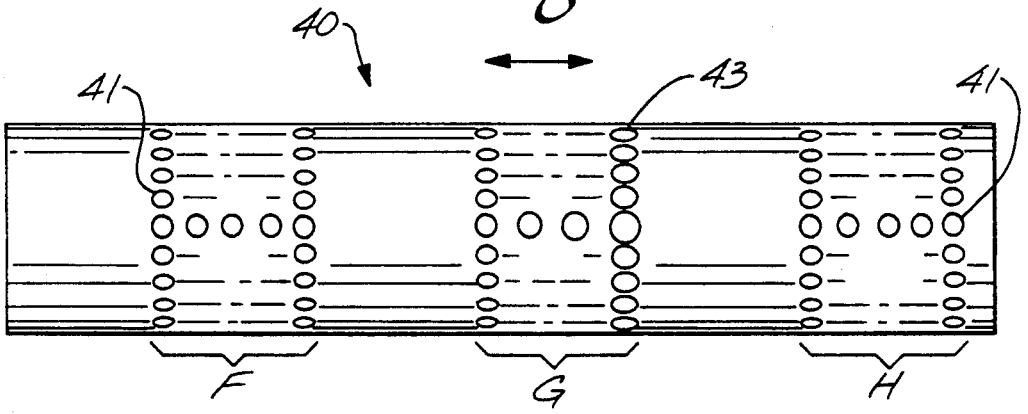
FIG. 5 is a schematic side elevation view of a sleeve incorporated in another embodiment of the invention.

In another embodiment of the invention, shown in FIG. 5, the sleeves 40 vary the water flow through the center portion of the core by their being translated along their axis rather than rotated about their axis as described in the previous embodiment. Parallel rows of circular holes 41, 43 are placed transversely along the sleeve alignable with the radial outlet passages. In the end portions of the sleeve, indicated by braces F and H the holes 41 are all of the same size. The holes 43 in the center portion of the sleeve, indicated by brace G, decrease in size along the axis of the sleeve. As in the embodiment previously described, the sleeve is incrementally movable from a maximum flow position, where the largest of the center holes are aligned with the center outlet passages to a minimum flow position, where the smallest of the center holes are aligned with the passages.

Figure 7:
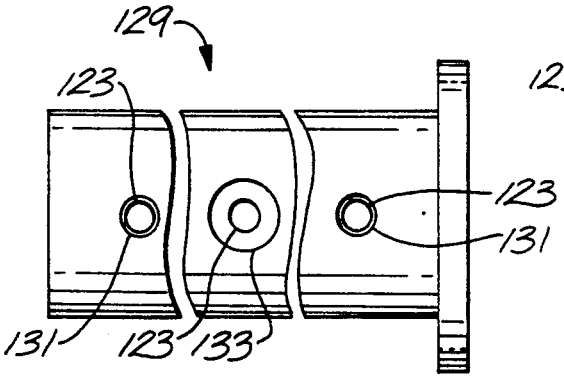
FIG. 7 is a schematic partial side elevation view of a sleeve shown in the maximum flow position incorporated in another embodiment of the invention.

In another embodiment of the invention, shown in FIG. 7, the sleeves 129 each have only a single set of openings 131 and 133 alignable with the outlet passages 123. The openings 133 in the portion of the core to receive additional cooling water, typically the center, are circular holes and are relatively larger than the openings 131, also circular holes, in the remainder of the sleeve. The center holes 133 and are larger than their associated outlet passages, while the remainder of the holes 131 are the same size as their associated outlet passages. As with the above described embodiment, means are provided to move the sleeves 129 from a maximum flow position to a minimum flow position.

Figure 8:
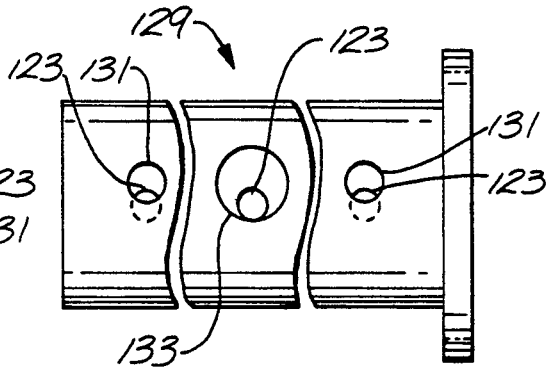
FIG. 8 is a schematic partial side elevation view of the sleeve depicted in FIG. 7 shown rotated about its axis to a minimum flow position.
Figure 9:
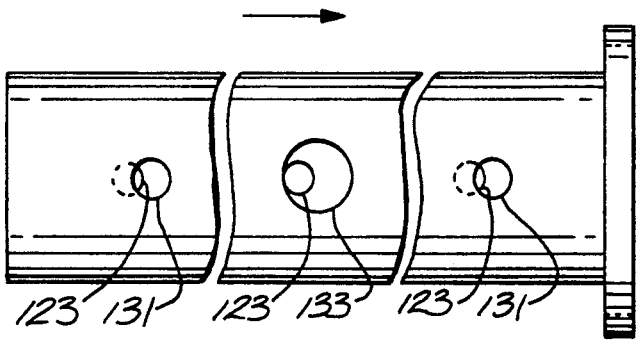
FIG. 9 is a schematic partial side elevation view of the sleeve depicted in FIG. 7 shown translated along its axis to a minimum flow position.

In the maximum flow position all the openings in each sleeve are in alignment with the outlet passages. The sleeves are moved to a minimum flow position by rotating the sleeves about their axis, as shown in FIG. 8, or translating the sleeves along their axis, as shown in FIG. 9. In the minimum flow position, the larger openings 133, due to their size being bigger than their associated outlet passages, still permit full water flow; while the remaining smaller openings 131 now partially occult their associated outlet passages permitting less water flow.

The total flow of water pumped through the cooling system may also be varied as the effective cross section of the smaller openings 131 is changed, permitting full control of the amount of cooling provided to the various portions of the core.

Figure 10:
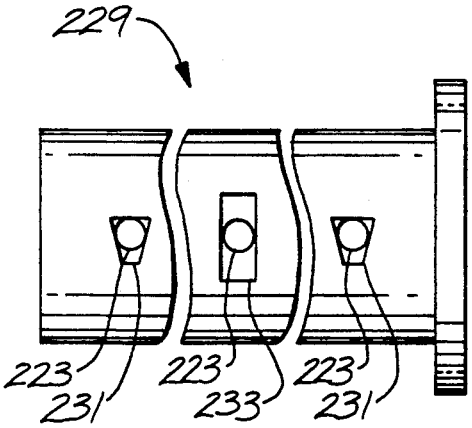
FIG. 10 is a schematic partial side elevation view of a sleeve shown in the maximum flow position incorporated in another embodiment of the invention.
Figure 11:
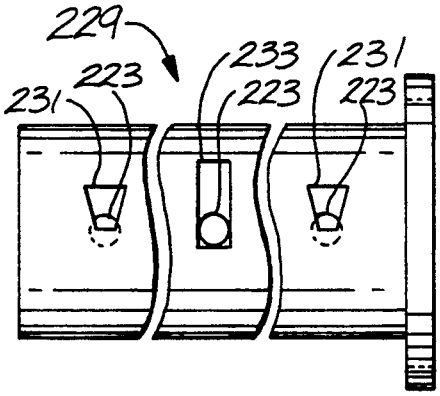
FIG. 11 is a schematic partial side elevation view of the sleeve depicted in FIG. 10 shown rotated about its axis to a minimum flow position.

In another embodiment of the invention, shown in FIGS. 10 & 11, differing shaped openings are used to control water flow to various portions of the core rather than different sized holes. The center openings 233 are shaped to permit a full flow of water at all settings of the sleeves 229 from the maximum to the minimum flow positions. A rectangular or other shape may be used for these openings having a long axis aligned with the direction of the rotation of the sleeves. The width of the openings are equal to or greater than the openings of their associated outlet passages.

The remainder of the openings 231, also have a long axis aligned with the direction of the rotation of the sleeves. However, the width of these openings vary along their long axes. Thus, rotating the sleeves to different positions results in differing cross sections of the openings being aligned with their associated outlet passages. To accomplish this, one end of the openings is wider than the diameter of their associated outlet passages while the other end is narrower. This change in the width of the openings may be tapered from the large end to the small end as required to provide the desired change in the flow of water in the ends of the core at various positions of the sleeves. For example, an even taper may be used to form trapezoidal or triangular shaped holes in the sleeves. Alternatively, curved sides on the openings may be used to obtain larger or smaller rates of change of flow as a function of movement of a sleeve.

Figure 12:
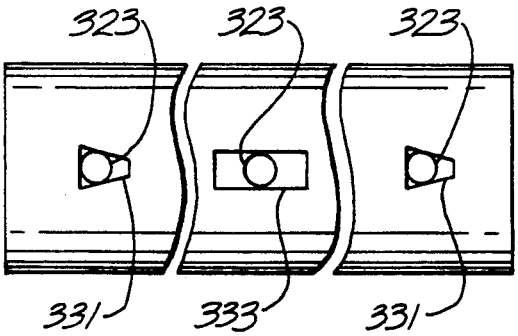
FIG. 12 is a schematic partial side elevation view of a sleeve shown in the maximum flow position incorporated in another embodiment of the invention.
Figure 13:
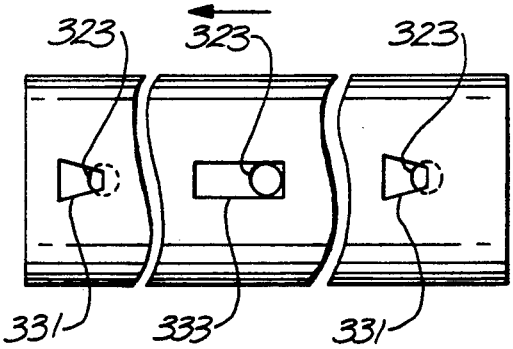
FIG. 13 is a schematic partial side elevation view of the sleeve depicted in FIG. 12 shown translated along its axis to a minimum flow position

In another embodiment of the invention, shown in FIGS. 12 & 13, differing shaped openings are again used to control water flow to various portions of the core. The center openings 333 are shaped to permit a full flow of water at all settings of the sleeves 329 from the maximum to the minimum flow positions. A rectangular or other shape may be used for these openings having a long axis aligned in the direction of the axis of the sleeves. The width of the openings 333 are equal to or greater than their associated outlet passages 223 along the full length of their long axes.

The remainder of the openings 331, also have a long axis aligned in the direction of the axis of the sleeves. However, the width of these openings vary along this axis. As in the previous embodiment, in different positions of the sleeves, differing cross sections of the openings are aligned with their associated outlet passages. To accomplish this one end of the openings is wider than the diameter of their associated outlet passages while the other end of the openings is narrower. Translating the sleeves along their axes between maximum and minimum flow positions changes the amount of water permitted to flow through these openings.

In another embodiment of the invention the sleeves 40 have a plurality of parallel rows of openings placed longitudinally along the sleeve. Each row of openings is configured to provide a different water volume flow through various portions of the of the core. The sleeves are rotated to align a selected row of openings with the radial outlet passages thereby creating a particular flow pattern through the core.

For example, a particular row may contain openings which permit a relatively larger water volume flow through the middle and end portions of the core while the two areas of the roll between these portions receive a relatively smaller water flow. The heat buildup in the roll resulting from this flow pattern would create a double crown profile in the outer surface of the roll. Another row may have contain openings which permit a relatively larger water volume flow only at one end of the core creating a roll having a crown at one end. Other desired crown profiles may be created by utilizing other patterns of openings.

The openings in each row are additionally configured to permit a change in water flow when the sleeves are translated, as described in the previous embodiment. For example, all the openings may be similarly tapered allowing the temperature of all portions the roll to be raised and lowered while maintaining the desired crown configuration. Thus, for example, the magnitude of the double crown pattern mentioned above may be controlled by shifting the sleeves longitudinally.

In view of the foregoing description of the invention, those skilled in the relevant arts will have no difficulties making changes and modifications in the different described elements of the invention in order to meet their specific requirements or conditions. For example, a two plenum core may be utilized or more than four plenums may be used. Various other shapes may also be used in the same or other locations on the sleeves. Other types of valving may be used to differentially control the flow of water through the core. Such changes and modifications may be made without departing from the scope and spirit of the invention as set forth in the following claims.

What is claimed is:

1. A roll casting machine comprising:

a frame;

a pair of work rolls mounted in the frame for rotation about parallel axes, each of the rolls comprising a shell secured on the core;

means for introducing molten metal to be cast into the bite between the work rolls;

means for circulating cooling water through the work rolls for extracting heat from the metal being cast; and means for controlling the cooling capacity of the water in at least a portion of one of the work rolls for providing a sufficient controlled temperature differential between the center portion and the ends of the roll for obtaining a controlled diameter differential between the center portion and the ends of the roll comprising:

at least one inlet plenum in the core, parallel to the longitudinal axis of the core;

at least one discharge plenum in the core, parallel to the longitudinal axis of the core;

a plurality of channels formed in the perimeter of the core;

a plurality of radially extending inlet passages in the core, each inlet passage interconnecting at least one channel and the inlet plenum;

a plurality of radially extending outlet passages in the core, each outlet passage interconnecting at least one channel and the discharge plenum;

means for introducing a cooling water into the inlet plenum and means for discharging the water from the discharge plenum; and means for controlling the cooling water flow through at least some of the channels relative to the remaining channels comprising:

at least one sleeve within a plenum, the sleeve having a plurality of openings through the sidewall of the sleeve, the openings being located for communicating with the radially extending passages; and means for moving the sleeve between a maximum flow position with at least a portion of the openings in relatively greater alignment with at least a portion of the radially extending passages, and a minimum flow position with the portion of openings in a relatively lesser alignment with the portion of the passages.

2. The roll casting machine of claim 1 wherein the direction of the movement of the sleeve between the maximum flow position and the minimum flow position is rotational about the axis of the sleeve.

3. The roll casting machine of claim 1 wherein the direction of the movement of the sleeve between the maximum flow position and the minimum flow position is translational along the axis of the sleeve.

4. A roll casting machine comprising:

a frame;

a pair of work rolls mounted in the frame for rotating about parallel axes, each of the rolls comprising a shell secured on the core;

means for introducing molten metal to be cast into the bite between the work rolls;

means for circulating cooling water through the work rolls for extracting heat from the metal being cast; and means for controlling the cooling capacity of the water in at least a portion of one of the work rolls for providing a sufficient controlled temperature differential between the center portion and the ends of the roll for obtaining a controlled diameter differential between the center portion and the ends of the roll comprising:

at least one inlet plenum in the core, parallel to the longitudinal axis of the core;

at least one discharge plenum in the core, parallel to the longitudinal axis of the core;

a plurality of channels formed in the perimeter of the core;

a plurality of radially extending inlet passages in the core, each inlet passage interconnecting at least one channel and the inlet plenum;

a plurality of radially extending outlet passages in the core, each outlet passage interconnecting at least one channel and the discharge plenum;

means for introducing a cooling water into the inlet plenum and means for discharging the water from the discharge plenum; and means for controlling the cooling water flow through at least some of the channels relative to the remaining channels comprising:

at least one sleeve within a plenum, the sleeve having a plurality of openings through the sidewall of the sleeve, the openings being located for communication with the radially extending passages; and means for moving the sleeve.

5. The roll casting machine of claim 4 wherein the openings through the sidewall of the sleeve comprise a first pattern of openings extending circumferentially around the sleeve, the openings being at least as large as and alignable with the radially extending passages near the ends of the roll;

a second pattern of openings extending circumferentially around the sleeve alignable with the radial passages in the center portion of the roll, the openings varying in size circumferentially around the sleeve from at least as large as the passages to a predetermined size smaller than the size of the passages; and means for rotating the sleeve about its axis between a maximum flow position with the first pattern of openings and the largest of the second pattern of openings in alignment with the radially extending passages, and a minimum flow position with the first pattern of openings and the smallest of the second pattern of openings in alignment with the passages.

6. The roll casting machine of claim 4 wherein the openings through the sidewall of the sleeve comprise:

a first pattern of openings extending longitudinally along the sleeve, the openings being at least as large as and alignable with the with the radially extending passages near the ends of the roll;

a second pattern of openings extending longitudinally along the sleeve alignable with the radially extending passages in the center portion of the roll, the openings varying in size longitudinally along the sleeve from at least as large as the passages to a predetermined size smaller than the size of the passages; and means for moving the sleeve longitudinally along its axis between a maximum flow position with the first pattern of openings and the largest of the second pattern of openings in alignment with the radially extending passages, and a minimum flow position with the first pattern of openings and the smallest of the second pattern of openings in alignment with the passages.

7. The roll casting machine of claim 6 wherein the openings through the sidewall of the sleeve comprise a first pattern of openings all of the same shape, the openings alignable with the radially extending passages near the center portion of the roll and having a width from one end to the other being at least as large as the width of the passages;

a second pattern of openings all of the same shape, the openings alignable with the radially extending passages near the ends of the roll, each opening having two opposite ends, the width at one end being at least as large as the width of the passages and the width at the other end being smaller than the width of the passages; and means for moving the sleeve between a maximum flow position with one end of the openings in alignment with the radially extending passages, and a minimum flow position with the other end of the openings in alignment with the passages.

8. The roll casting machine of claim 7 wherein the means for moving the sleeve rotates the sleeve about its axis between the maximum flow position and the minimum flow position.

9. The roll casting machine of claim 7 wherein the means for moving the sleeve translates the sleeve along its axis between the maximum flow position and the minimum flow position.

10. The roll casting machine of claim 4 wherein the openings through the sidewall of the sleeve comprise:

two or more rows of openings extending longitudinally along the sleeve, each row having a different pattern of openings alignable with the with the radially extending passages; and means for rotating and translating the sleeve such that the sleeve may be rotated to align a preselected row of openings with the radially extending passages and translated to vary the volume of water flow through the preselected row of openings.

11. A roll comprising:

a core having at least one axially extending cooling water inlet plenum;

the core additionally having at least one axially extending cooling water outlet plenum;

a shell fixed on the core;

a plurality of cooling water channels in the perimeter of the core;

a plurality of radially extending cooling water passages between the plenums and the channels; and means for controlling the thermal expansion of the core by changing the cooling capacity of the water in at least a portion of the core of the work roll for providing a controlled temperature differential in the core between the center portion and the ends of the roll, comprising:

a plurality of radially extending inlet passages in the core, each inlet passage interconnecting at least one channel and the inlet plenum;

a plurality of radially extending outlet passages in the core, each outlet passage interconnecting at least one channel and the discharge plenum;

means for introducing a cooling water into the inlet plenum and means for discharging the water from the discharge plenum; and means for controlling the cooling water flow through at least some of the channels relative to the remaining channels comprising:

at least one sleeve within a plenum, the sleeve having a plurality of openings through the sidewall of the sleeve, the openings being located for communicating with the radially extending passages; and means for moving the sleeve between a maximum flow position with at least a portion of the openings in relatively greater alignment with at least a portion of the radially extending passages, and a minimum flow position with the portion of openings in a relatively lesser alignment with the portion of the passages.

12. The roll of claim 11 wherein the movement of the sleeve between the maximum flow position and the minimum flow position is rotational about the axis of the sleeve.

13. The roll of claim 11 wherein the movement of the sleeve between the maximum flow position and the minimum flow position is translational along the axis of the sleeve.

14. A roll for a casting machine comprising:

a core having at least one axially extending cooling water inlet plenum;

the core additionally having at least one axially extending cooling water outlet plenum;

a shell fixed on the core;

a plurality of cooling water channels in the perimeter of the core;

a plurality of radially extending cooling water passages between the plenums and the channels; and means for controlling the cooling capacity of the water in at least a portion of the work roll for providing a controlled temperature differential between the center portion and the ends of the roll, comprising:

a plurality of radially extending inlet passages in the core, each inlet passage interconnecting at least one channel and the inlet plenum;

a plurality of radially extending outlet passages in the core, each outlet passage interconnecting at least one channel and the discharge plenum;

means for introducing a cooling water into the inlet plenum and means for discharging the water from the discharge plenum; and means for controlling the cooling water flow through at least some of the channels relative to the remaining channels comprising:

at least one sleeve within a plenum, the sleeve having a plurality of openings through the sidewall of the sleeve, the openings being located for communicating with the radially extending passages; and means for moving the sleeve.

15. The roll of claim 14 wherein the openings through the sidewall of the sleeve comprise a first pattern of openings extending circumferentially around the sleeve, the openings being at least as large as and alignable with the radially extending passages near the ends of the roll;

a second pattern of openings extending circumferentially around the sleeve alignable with the radial passages in the center portion of the roll, the openings varying in size circumferentially around the sleeve from at least as large as the radially extending passages to a predetermined size smaller than the size of the passages; and means for rotating the sleeve about its axis between a maximum flow position with the first pattern of openings and the largest of the second pattern of openings in alignment with the passages, and a minimum flow position with the first pattern of openings and the smallest of the second pattern of openings in alignment with the passages.

16. The roll of claim 14 wherein the openings through the sidewall of the sleeve comprise a first pattern of openings extending longitudinally along the sleeve, the openings being at least as large as and alignable with the with the radially extending passages near the ends of the roll;

a second pattern of openings extending longitudinally along the sleeve alignable with the radially extending passages in the center portion of the roll, the openings varying in size longitudinally along the sleeve from at least as large as the passages to a predetermined size smaller than the size of the passages; and means for moving the sleeve longitudinally along its axis between a maximum flow position with the first pattern of openings and the largest of the second pattern of openings in alignment with the passages, and a minimum flow position with the first pattern of openings and the smallest of the second pattern of openings in alignment with the passages.

17. The roll of claim 14 wherein the openings through the sidewall of the sleeve comprise:

a first pattern of openings all of the same shape, the openings alignable with the radially extending passages near the center portion of the roll and having a width from one end to the other being at least as large as the width of the passages;

a second pattern of openings all of the same shape, the openings alignable with the radially extending passages near the ends of the roll, each opening having two opposite ends, the width at one end being at least as large as the width of the passages and the width at the other end being a predetermined amount smaller than the width of the passages; and means for moving the sleeve between a maximum flow position with one end of the openings in alignment with the radially extending passages, and a minimum flow position with the other end of the openings in alignment with the passages.

18. The roll of claim 17 wherein the means for moving the sleeve rotates the sleeve about its axis between the maximum flow position and the minimum flow position.

19. The roll of claim 17 wherein the means for moving the sleeve translates the sleeve along its axis between the maximum flow position and the minimum flow position.

20. The roll of claim 14 wherein the openings through the sidewall of the sleeve comprise two or more rows of openings extending longitudinally along the sleeve, each row having a different pattern of openings alignable with the with the radially extending passages; and means for rotating and translating the sleeve such that the sleeve may be rotated to align a preselected row of openings with the radially extending passages and translated to vary the volume of water flow through the preselected row of openings.

21. A method of controlling the profile of sheet produced on a roll casting machine comprising the steps of:

introducing molten metal to be cast into the bite between a pair of parallel rotating work rolls each having a core and a shell fixed on the core;

circulating cooling water through the core of the work rolls for extracting heat from the metal being cast; and controlling thermal expansion of at least one of the cores by changing the cooling capacity of the water in at least a portion of one of the work rolls for providing a controlled temperature differential in the core of the roll between the center portion and the ends of the roll comprising:

introducing a cooling water into at least one inlet plenum in the core;

circulating the water from the inlet plenum through a plurality of radially extending inlet passages in the core, a plurality of channels formed in the perimeter of the core, and a plurality of radially extending outlet passages in the core to at least one discharge plenum;

discharging the water from the discharge plenum; and controlling the cooling water flow through at least some of the channels relative to the remaining channels comprising:

the step of moving at least one sleeve within a plenum, the sleeve having a plurality of openings through the sidewall thereof, the openings being located for communication with the radially extending passages, between a maximum flow position with at least a portion of the openings in relatively extending passages, and a minimum flow position with the portion of openings in a relatively lesser alignment with the portion of the passages.

22. A method of controlling the profile of sheet produced on a roll casting machine comprising the steps of:

introducing molten metal to be cast into the bits between a pair of parallel rotating work rolls each having a core and a shell fixed on the core;

circulating cooling water through the core of the work rolls for extracting heat from the metal being cast; and controlling thermal expansion of at least one of the cores by changing the cooling capacity of the water in at least a portion of one of the work rolls for providing a controlled temperature differential int he core of the roll between the center portion and the ends of the roll comprising:

introducing a cooling water into at least one inlet plenum in the core;

circulating the water from the inlet plenum through a plurality of radially extending inlet passages in the core, a plurality of channels formed in the perimeter of the core, and a plurality of radially extending outlet passages in the core to at least one discharge plenum;

discharging the water from the discharge plenum; and controlling the cooling water flow through at least some of the channels relative to the remaining channels comprising:

the step of moving at least one sleeve within a plenum, the sleeve having a plurality of openings through the sidewall thereof, the openings being located for communication with the radially extending passages, between a maximum flow position with at least a portion of the openings in alignment with passages being at least as large as the passages, and a minimum flow position with at least a portion of openings in alignment passages being smaller than the passages.

23. A method of controlling the profile of sheet produced on a roll casting machine comprising the steps of:

introducing molten metal to be cast into the bits between a pair of parallel rotating work rolls each having a core and a shell fixed on the core;

circulating cooling water through the core of the work rolls for extracting heat from the metal being cast; and controlling thermal expansion of at least one of the cores by changing the cooling capacity of the water in at least a portion of one of the work rolls for providing a controlled temperature differential in the core of the roll between the center portion and the ends of the roll comprising:

introducing a cooling water into at least one inlet plenum in the core;

circulating the water from the inlet plenum through a plurality of radially extending inlet passages in the core, a plurality of channels formed in the perimeter of the core, and a plurality of radially extending outlet passages in the core to at least one discharge plenum;

discharging the water from the discharge plenum; and controlling the cooling water flow through at least some of the channels relative to the remaining channels comprises the additional steps of:

rotating to a preselected position at least one sleeve within a plenum, the sleeve having two or more rows of openings through the sidewall thereof extending longitudinally along the sleeve, each row defining a selectable position of the sleeve and having a different pattern of openings alignable with the radially extending passages; and translating the sleeve to vary the volume of water flow through the preselected row of passages.

* * * * *